United States Patent [19]

Olson

[11] 4,239,454

[45] Dec. 16, 1980

[54] OVERLOAD PROTECTION CONTROL CIRCUIT FOR MARINE ENGINES

[75] Inventor: Paul E. Olson, Lexington, Ky.

[73] Assignee: American Standard Inc., Lexington, Ky.

[21] Appl. No.: 936,670

[22] Filed: Aug. 24, 1978

[51] Int. Cl.[3] ..... B63H 3/10

[52] U.S. Cl. ..... 416/27; 416/43

[58] Field of Search ..... 416/25, 27, 30, 43

[56] References Cited

U.S. PATENT DOCUMENTS

| | | | |
|---|---|---|---|
| 2,878,880 | 3/1959 | Gillespie | 416/27 |
| 2,923,361 | 2/1960 | Best | 416/27 |
| 2,958,381 | 11/1960 | Stevens et al. | 416/27 |
| 3,088,523 | 5/1963 | Smalley et al. | 416/27 X |
| 3,302,724 | 2/1967 | Brooks et al. | 416/27 |
| 3,588,272 | 6/1971 | Lindahl et al. | 416/27 X |
| 3,724,970 | 4/1973 | Kobelt | 416/27 |
| 3,826,590 | 7/1974 | Kobelt | 416/27 |
| 3,915,590 | 10/1975 | Bjorknas | 416/43 |
| 4,142,829 | 3/1979 | Inoue et al. | 416/27 X |

FOREIGN PATENT DOCUMENTS

| | | | |
|---|---|---|---|
| 1200588 | 7/1970 | United Kingdom | 416/30 |
| 575268 | 10/1977 | U.S.S.R. | 416/27 |

*Primary Examiner*—Everette A. Powell, Jr.

*Attorney, Agent, or Firm*—R. S. Visk; R. W. McIntire, Jr.

[57] ABSTRACT

An overload protection control circuit for marine engines, in which a propeller pitch control signal, as initiated by the operator and transmitted to a servo-positioner for setting the propeller pitch, is modified by a speed control signal, also initiated by the operator, for setting the speed of the ship through a speed governor device, so that the pitch of the propeller is automatically maintained at a degree compatible with the ship speed. According to the invention, an overload limiting valve device is interposed in the protection control circuit and is preset to respond to a critical engine load condition to effect operation of the servo-positioner to a neutral position in which propeller pitch is reduced to a safe degree.

5 Claims, 3 Drawing Figures

OVERLOAD PROTECTION CONTROL CIRCUIT FOR MARINE ENGINES

BACKGROUND OF THE INVENTION

In many of the known ship propulsion systems having controllable pitch propellers, separate controls are required for engine speed and propeller pitch, respectively. This can be an exhausting job for the operator since all the variable conditions encountered due to ship load, water currents, waves, wind, etc. have an effect on the engine loading. It would be desirable, therefore, to coordinate propeller pitch and engine speed in such a manner as to prevent overload of the engine by adjusting the pitch of the propeller automatically according to prevailing engine load.

SUMMARY OF THE INVENTION

The object of the present invention, therefore, is to provide an engine overload protection control circuit for automatically effecting reduction of propeller pitch to a minimum angle in response to an engine overload condition.

According to the invention, operator-initiated or set propeller pitch and speed control signals are transmitted to a servo-positioner (for setting propeller pitch) and a speed governor actuator, respectively, thus calling for an increase in propeller pitch and an increase in engine speed. In response to the speed control signal, the governor effects an increase in fuel supply accordingly, which is read by a fuel rack position sensor, which, in turn, transmits a corresponding signal to a relay valve device to which the set speed signal is also transmitted. The relay valve compares the fuel rack and set speed signals. When the fuel rack signal becomes higher than the set speed signal, the relay valve multiplies the differential by a predetermined factor and feeds the resulting correction signal, via an engine overload limiting valve, to a servo-positioner for effecting a reduction of propeller pitch accordingly. The servo-positioner has an operating diaphragm with pressure chambers on opposite sides thereof, so that depending upon which chamber has the higher pressure, the propeller pitch is set for ahead or astern travel. If the maximum allowable overload for the particular engine in use is approached, so that the correction pressure signal from the relay valve exceeds the limit setting of the limiting valve, said correction signal causes operation of the limiting valve to a position in which the full or set pitch signal is connected to both diaphragm chambers of the servo-positioner, thus causing propeller pitch to be reduced rapidly to relieve the engine overload condition.

DESCRIPTION AND OPERATION

Figure 1:
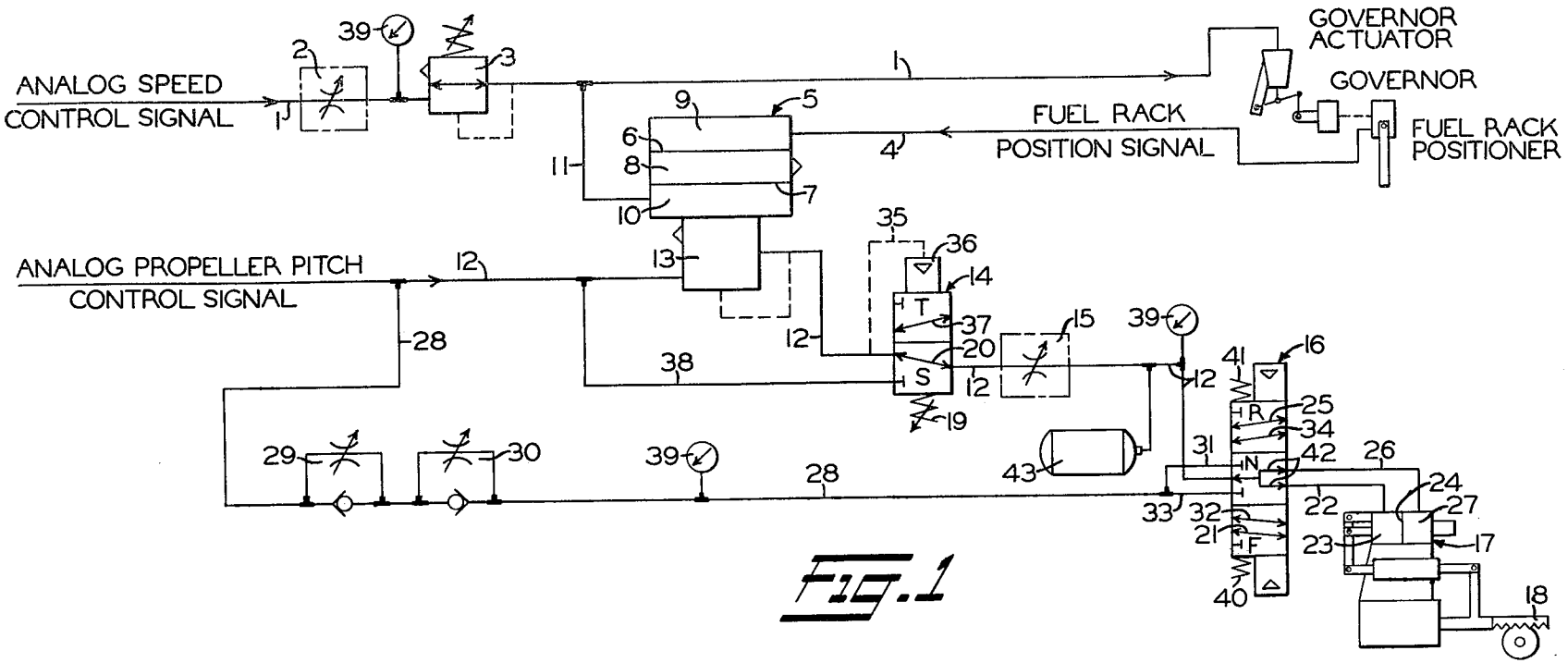
FIG. 1 is a schematic view of an overload protection circuit embodying the invention.

As shown in FIG. 1, an overload protection circuit for a ship propulsion system comprises a conduit 1 via which a fluid pressure analog speed control signal, as initiated by the operator at a control station (not shown), is transmitted to a speed governor actuator to set the position of a fuel rack for determining fuel supply to the engine. A choke 2 of relatively large flow capacity is interposed in conduit 1 to moderate the impact or surge of the pressure of the speed control signal at its inception. Also interposed in conduit 1 downstream of choke 2 is an adjustable pressure-setting valve 3 for setting the maximum safe speed signal allowed to be transmitted through said conduit.

A normal speed control signal, which is an analog signal, is transmitted via conduit 1 to a governor actuator which, in turn, sets the position of a fuel rack according to the degree of the control signal. A fuel rack position sensor (not shown) causes a fuel rack position signal to be fed back via a conduit 4 to a relay valve device 5 shown diagrammatically in FIG. 1.

Relay valve device 5 comprises a pair of opposingly operable upper and lower diaphragms 6 and 7 with an atmospheric chamber 8 formed therebetween. Pressure chambers 9 and 10 are formed adjacent each of diaphragms 6 and 7 at the sides opposite atmospheric chamber 8, respectively. A branch conduit 11 connects conduit 1 to chamber 10 of relay valve device 5.

A propeller pitch control signal, initiated by the operator, is transmitted via a conduit 12 in which a relay portion 13 of relay valve device 5, an overload limiting valve device 14, a relatively large flow capacity choke 15, and a direction-setting valve device 16 are all serially interposed in the order stated. The pitch control signal is normally a fluid pressure analog signal, and choke 15 serves a purpose similar to that mentioned above in connection with choke 2.

Relay valve device 5 compares the speed control signal transmitted to chamber 10 with the fuel rack position signal transmitted to chamber 9. If the fuel rack signal becomes greater than the selected speed control signal, the relay valve device multiplies the difference by a preselected factor (compatible with the protection limits) and transmits such modified or correction signal via limiting valve device 14, choke 15, and direction-setting device 16 to a servo-positioner 17 which sets or adjusts the propeller pitch by a gear and rack arrangement 18.

Figure 2:
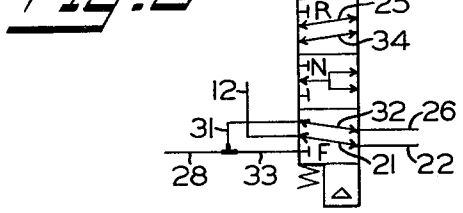
FIG. 2 is a diagrammatic representation of a direction-setting valve device included in the protection circuit and shown in a certain position.

The load-limiting valve 14 is biased by a spring 19 to a normal supply position, indicated S in the drawing, in which a passageway 20 opens communication via conduit 12 through said load-limiting device. Assuming that the direction-setting valve device 16 has been set in a forward or ahead travel position, indicated F in the drawing and shown in said forward position in FIG. 2, the correction signal transmitted from relay valve device 5 via load-limiting valve 14, is transmitted through a passageway 21 in said direction-setting device and via a conduit 22 to an astern chamber 23 adjacent the left side, as viewed in the drawing, of an operating piston 24 of the servo-positioner 17, which will be more fully explained hereinafter. If the direction-setting device 16 were set in reverse or astern travel position, indicated R in the drawing, the correction signal from the relay valve device would be transmitted via a passageway 25 in said direction-setting device and via a conduit 26 to an ahead chamber 27 adjacent the right side of operating piston 24 of the servo-positioner 17.

Normally a propeller pitch control signal, as initiated or set by the operator when he initiates the speed control signal is transmitted to the servo-positioner via a conduit 28 branching off conduit 12. A pair of choke-check devices 29 and 30 are serially interposed in conduit 28 to prevent sudden flow surges of the propeller pitch signal pressure in conduit 28 in both directions, that is when supplied (choke-check 30) and when released (choke-check 29). With direction-setting valve 16 in its forward travel position F, the propeller pitch signal is transmitted from conduit 28 via a branch conduit 31, a passageway 32 in said direction-setting device, and conduit 26 to the ahead chamber 27 of servo-positioner 17. It should be obvious that if the direction-setting device 16 were in its reverse travel position R, the propeller pitch signal would be transmitted from conduit 28 via a branch conduit 33, a passage way 34 in said direction-setting device, and conduit 22 to astern chamber 23 of servo-positioner 17.

The pressure of the propeller pitch control signal transmitted via conduit 28 to servo-positioner 17 is normally greater than the pressure of the correction signal transmitted from relay valve device 5, so that, depending upon the position of the direction-setting device 16 and, therefore, which of the chambers 23 or 27 is accordingly charged with the propeller pitch control signal pressure, propeller pitch is set accordingly to cause a corresponding direction of movement of the vessel. If the pressure of the fuel rack signal transmitted to chamber 9 of relay valve device 5 becomes greater than the pressure of the speed control signal transmitted to chamber 10, said relay valve device measures the pressure difference and multiplies it by a predetermined factor so as to produce the correction pressure signal and transmit such signal to the servo-positioner device 17. Pressure of the propeller pitch correction signal transmitted from relay portion 13 of relay valve device 5, as above noted, and transmitted to one or the other of the astern or ahead chambers 23 and 27, respectively (depending on the position of the direction-setting device 16) acts on the respective adjacent side of operating piston 24 in opposition to the normally greater pressure of the propeller pitch control signal acting on the opposite side of said operating piston to effect correction of propeller pitch accordingly. Thus, as long as the pressure of the propeller pitch control signal exceeds that of the correction signal, the propeller pitch is determined by the prevailing ratio of the two pressures.

If the maximum allowable overload of the particular engine in use is approached, pressure of the correction signal from relay portion 13 of relay valve device 5 is transmitted via a passageway 35 in load-limiting valve 14 to an operating piston portion 36 of said load-limiting valve device. If such pressure of the correction signal exceeds the adjusted setting of spring 19, the load-limiting valve device 14 is caused to shift from its supply position S, in which it is shown, to a transfer position T. In the transfer position T, passageway 20 of load-limiting valve device 14 is cut off from relay valve device 5 to cut off further passage of the propeller pitch correction signal therethrough to servo-positioner 17.

Figure 3:
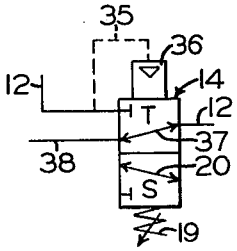
FIG. 3 is a diagrammatic representation of a load-limiting valve device included in the protection circuit and shown in a certain position.

With load-limiting valve device 14 in its transfer position T, a passageway 37 formed therein places conduit 12 on the outlet side of said load-limiting valve device in communication with a bypassing conduit 38 branching off conduit 12 ahead of relay portion 13 of relay valve device 5. See FIG. 3. Thus, assuming the direction-setting valve device 16 to be in position F, the full pressure of the propeller pitch control signal is transmitted via load-limiting valve device 14, conduit 12, passageway 21, and conduit 22 to astern chamber 23, thereby balancing the pressure in ahead chamber 27 and causing piston 24 to assume a neutral position corresponding to zero propeller pitch. It should be apparent that if direction-setting device 16 were in position R, full pressure of the propeller pitch control signal would be transmitted to ahead chamber 27 to balance the pressure in astern chamber 23.

Several pressure gauges 39 are installed at various convenient locations in the protection control circuit for checking pressures therein.

The direction-setting valve device 16, until operated to either the forward or reverse positions F or R, respectively, is normally biased by opposingly disposed springs 40 and 41 to a neutral position indicated N and in which it is shown in FIG. 1. In the neutral position N, a bifurcated passageway 42, formed in direction-setting device 16, simultaneously places conduit 12 in communication with both conduits 22 and 26 and therefore in communication with both the astern and ahead chambers 23 and 27 for retaining operating piston 24 in a neutral disposition corresponding to zero propeller pitch.

A fluid pressure reservoir or volume 43 is connected to conduit 12 between choke 15 and direction-setting valve device 16, said volume being charged from fluid pressure in said conduit during transmission of the pitch control signal to the servo-positioner 17. Thus, when the engine is shut down, that is, when the propeller pitch control pressure signal in conduit 12 is cut off by the operator, the pressure in volume 43 will permit gradual change in propeller pitch rather than a sudden, abrupt change which could damage the propeller.

Having now described the invention, what I claim as new and desire to secure by Letters Patent, is:

1. An overload protection circuit for a marine engine comprising:

(a) servo-positioning means including a double-acting piston device and gear means connected thereto and operable thereby for setting propeller pitch, either forward or reverse, in accordance with the predominating one of respective opposing fluid pressure signals acting on opposite sides of said piston device;

(b) relay valve means including a pair of opposingly arranged pressure chambers;

(c) first conduit means for transmitting an operator-initiated fluid pressure speed control signal to one of said pressure chambers of said relay valve means and to a fuel rack positioner device, said fuel rack positioner being effective for producing a backfeed fuel rack position signal transmitted to the other of said pressure chambers of said relay valve means, (d) said relay valve means being operable for producing a fluid pressure propeller pitch correction signal, in accordance with the ratio of said speed control signal and said fuel rack position signal, and transmitting said correction signal to one side of said opposite sides of said double-acting piston device and effecting both direction and degree of propeller pitch accordingly;

(e) second conduit means for transmitting an operator-initiated fluid pressure propeller pitch control signal to the other side of said opposite sides of said piston device and cooperating with said correction signal for setting the position of the piston device and consequently propeller pitch in accordance with the relationship of the respective fluid pressure signals acting concurrently on said opposite sides, (f) said piston device being operable to assume a neutral position in which propeller pitch is zero when the pressures acting on said opposite sides are equal; and (g) overload limiting valve means interposed in said second conduit means between said relay valve means and said servo-positioning means, said overload limiting valve means having a preset pressure limit and being operable responsively to said correction signal at a pressure exceeding said pre-set pressure limit, to a certain supply position in which said fluid pressure pitch control signal is communicated concurrently to both said opposite sides of said piston device for effecting operation thereof to its said neutral position in which propeller pitch is reduced to zero.

2. An overload protection circuit for a marine engine, as set forth in claim 1, further including a direction-setting valve device interposed in said second conduit means and between said overload limiting valve means and said positioning means, said direction-setting valve device being operable from a neutral position to a forward position in which said propeller pitch control signal and said propeller pitch correction signal are directed to said opposite sides such as to effect forward propeller pitch, and being operable to a reverse position in which said propeller pitch control signal and said propeller pitch correction signal are directed to said opposite sides such as to effect reverse propeller pitch.

3. An overload protection circuit for a marine engine, as set forth in claim 2, wherein the pressure of said propeller pitch control signal is normally greater than the pressure of said propeller pitch correction signal.

4. An overload protection circuit for a marine engine, as set forth in claim 1, further characterized by a first choke interposed in said first conduit means for inhibiting abrupt transmission of said speed control signal, and a second choke interposed between said relay valve means and said positioning means for inhibiting abrupt transmission of said correction signal.

5. An overload protection circuit for a marine engine, as set forth in claim 1, further characterized by a pair of choke-check devices serially interposed in said second conduit means for inhibiting abrupt flow surges of fluid pressure therein in both directions.

* * * * *